United States Patent [19]

Nicol

[11] Patent Number: 4,969,600

[45] Date of Patent: Nov. 13, 1990

[54] FUEL INJECTION NOZZLE

[75] Inventor: Stuart W. Nicol, London, England

[73] Assignee: Lucas Industries, England

[21] Appl. No.: 433,969

[22] Filed: Nov. 8, 1989

[30] Foreign Application Priority Data

Dec. 2, 1988 [GB] United Kingdom ..... 8828157

[51] Int. Cl.[5] ..... F02M 47/02

[52] U.S. Cl. ..... 239/88; 239/90; 239/124; 239/585; 251/30.01; 123/458; 123/506

[58] Field of Search ..... 251/30.01; 123/458, 123/506, 500, 501; 239/585, 90, 93, 88, 96, 124, 127, 533.2, 533.8, 91

[56] References Cited

U.S. PATENT DOCUMENTS

| | | | |
|---|---|---|---|
| 4,129,253 | 12/1978 | Bader, Jr. et al. | 239/124 |
| 4,489,886 | 12/1984 | Kato | 239/124 |
| 4,498,625 | 2/1985 | Schechter | 239/124 |
| 4,527,737 | 7/1985 | Deckard | 239/124 |
| 4,566,416 | 1/1986 | Berchtold | 123/458 |
| 4,605,166 | 8/1986 | Kelly | 239/96 |
| 4,669,659 | 6/1987 | LeBlanc et al. | 239/124 |
| 4,793,315 | 12/1988 | Phillips | 251/30.01 |

FOREIGN PATENT DOCUMENTS

| | | | |
|---|---|---|---|
| 0196265 | 1/1986 | European Pat. Off. | 239/124 |

*Primary Examiner*—Andres Kashnikow
*Assistant Examiner*—Christopher G. Trainor
*Attorney, Agent, or Firm*—Andrus, Sceales, Starke & Sawall

[57] ABSTRACT

A fuel injection nozzle includes a fuel pressure actuated valve member which is biased into contact with a seating by resilient means. The nozzle also includes a spill valve member having a head which is biased into contact with a seating by the resilient means. The head of the spill valve is lifted from the seating by the application of fuel under pressure to a piston portion of the spill valve member. When the head of the spill valve is lifted from the seating fuel is spilled from the nozzle inlet to a drain.

4 Claims, 1 Drawing Sheet

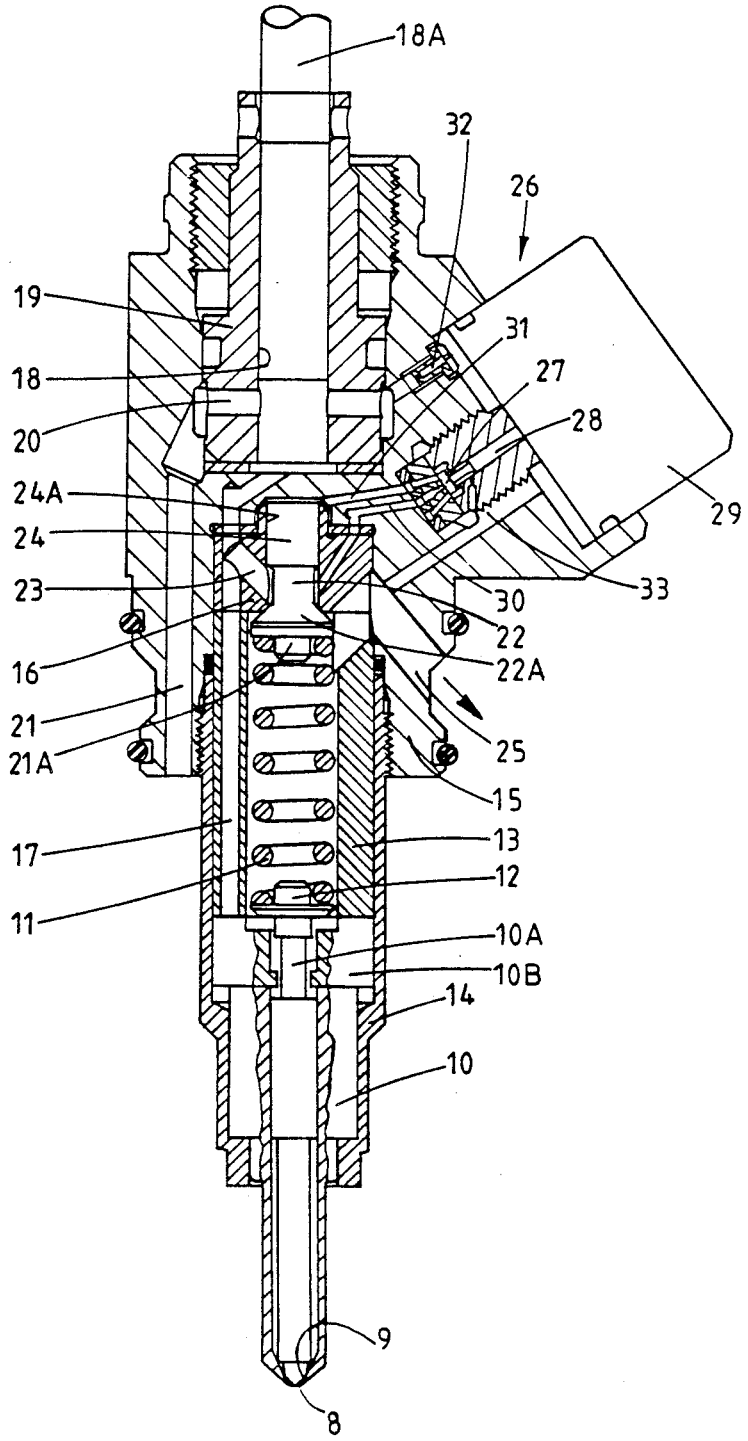
18A
32
26
19
31
18
27
20
28
24A
29
24
23
30
33
22
16
22A
21
25
21A
15
17
13
12
11
10A
10B
14
10
9
8

FUEL INJECTION NOZZLE

This invention relates to a fuel injection nozzle for supplying fuel to an internal combustion engine and of the kind comprising a valve member which is movable by fuel under pressure supplied to a nozzle inlet, away from a seating to allow fuel flow through an outlet, the valve member being biased into contact with the seating by resilient means.

Such nozzles are well known in the art and in use, the inlet of the nozzle is connected to an outlet of a high pressure fuel injection pump. The termination of delivery of fuel through the nozzle occurs when the pressure of fuel supplied by the pump is reduced and it is known to effect this reduction using a spill valve which when open, spills fuel to a drain. In one example the spill valve includes a valve member which is coupled to an electromagnetic actuator but such an arrangement requires a powerful actuator in order to achieve the desired speed of operation with the desired flow area.

The object of the present invention is to provide a fuel injection nozzle in a simple and convenient form.

According to the invention a fuel injection nozzle of the kind specified comprises a spill valve including a spill valve member which is biased into contact with a spill valve seating by said resilient means, to prevent flow of fuel from the nozzle inlet to a drain, the spill valve member including a piston portion slidable in a cylinder and electromagnetic valve means for admitting fuel under pressure from said nozzle inlet into said cylinder to cause movement of the spill valve member to the open position.

An example of a fuel injection nozzle in accordance with the invention will now be described with the reference to the accompanying part sectional side elevation which shows a nozzle combined with a pump, the combination being more commonly known in the art as a pump/injector.

Referring to the drawing the injector comprises a nozzle body 10 in which is located a slidable valve member 10A. which is biased into contact with a seating 9 by means of a coiled compression spring 11. One end of the spring engages a spring abutment 12 which is engaged with the valve member and the latter in known manner, defines a surface against which fuel under pressure supplied to an inlet of the nozzle body, can act to lift the valve member away from the seating to permit fuel flow through an outlet 8.

The nozzle body is retained relative to a hollow tubular member 13 by means of a cap nut 14 which is externally screw threaded and which is engaged within a threaded opening in the injector body 15. Interposed between the tubular member 13 and the base wall of the recess in the body is a spill valve housing 16 and the housing 16 together with the tubular member 13 have formed therein a passage 17 through which fuel is supplied to the inlet of the nozzle body from the end of a bore 18 which is formed in a pump barrel 19 secured within the injector body Moreover, interposed between the nozzle body 10 and the tubular member 13 is a distance piece 10B which acts to limit the movement of the valve member away from the seating in the usual way.

Slidably mounted in the bore 18 is a pumping plunger 18A which in the use of the injector, is actuated by an engine driven cam. The cam drives the plunger 18A inwardly and the plunger is returned by the conventional spring. Extending from the bore 18 are a pair of supply passages 20 which open into an annular chamber defined about the pump barrel and the chamber communicates with a fuel inlet 21 which is connected in use, to a low pressure fuel supply pump. During the inward movement of the plunger under the action of the cam, fuel in the bore 18 will be displaced through the passages 20 until the latter are covered by the plunger whereupon the fuel in the bore will be pressurised and supplied by way of the passage 17 to the inlet of the nozzle.

The spring 11 is housed within the tubular member 13 and its end remote from the valve member is engaged with a spring abutment 21A which engages or forms part of the head 22A of a spill valve member 22 which is slidable within a cylinder 24A formed in the valve housing 16. The spill valve member is of reduced diameter beneath the head to form an annular chamber which is in constant communication with the passage 17 by way of a drilling 23. The spill valve member 22 defines a piston portion 24 and fuel under pressure can be applied against the piston portion 24 to lift the head 22A of the spill valve member away from a seating defined at the junction of the end face of the valve housing presented to the tubular member 13 and the cylinder 24A in the valve housing. The end area of the piston portion 24 is greater than the area of the valve member 10A exposed to the pressure of the fuel supplied to the inlet of the nozzle body. The chamber within the tubular member 13 is connected to a drain by way of a passage 25 in the body of the injector and a cooperating passage defined by the tubular member 13 and the valve housing 16.

In order to control the application of fuel under pressure to the piston portion 24, there is provided an electromagnetically operated valve means indicated generally at 26. The valve means includes a plate valve member 27 which is urged into contact with a seating by means of the output member 28 of an electromagnetic device 29 and when so urged into contact with the seating, a passage 30 which communicates with the annular chamber defined beneath the valve head, is obturated. Moreover, a further passage 31 which is connected to a space at the end of the bore in the valve housing, is connected to a drain. In the closed position of the spill valve, the spill valve member is substantially pressure balanced, and the force exerted by the spring maintains the head 22A in contact with the seating.

In operation, with the valve member 27 obturating the passage 30, during inward movement of the pumping plunger 18A fuel will be delivered through the passage 17 to the outlet of the nozzle. If, whilst the plunger 18A is moving inwardly, the electromagnetic device 29 is de-energised, the plate valve member 27 will be lifted from its seating to allow fuel under pressure to pass through the passage 31 to act on the end face of the piston portion 24 of the spill valve member. The effect will be to cause the spill valve member 22 to move to the open position thereby to allow the remaining quantity of fuel displaced by the plunger to flow through the passage 23 to drain by way of the passage 25. Since the movement of the spill valve member 22 will be against the action of the spring 11, the force exerted by the spring 11 upon the valve member 10A of the nozzle will be increased thereby facilitating the movement of the valve member 10A of the nozzle to the closed position.

Upon completion of the inward movement of the plunger 18A by the engine driven cam, the plunger is moved outwardly by its return spring in the usual manner and fuel will flow into the bore 18 through the passages 20 when the latter are uncovered by the plunger.

If desired the valve means 26 can also be used to control the start of delivery of fuel as well as the end of delivery of fuel. In practice two separate valves would be provided. one to control the start of injection and the other to control the end of injection of fuel to the engine. This ensures that the effective valve operating time can be sufficiently short for low load high speed operation of the associated engine.

The passages 30 and 31 can be of small diameter since the flow of fuel along the passages to achieve operation of the spill valve member 22 is very small the volume of the passages therefore does not add significantly to the total volume of fuel which is subject to high pressure. Moreover, because of the very small volume of fuel which pass through the passages 30 and 31, the diameter of the seating against which the plate valve member 27 is urged whilst fuel is being supplied through the nozzle, can be made comparatively small and this minimises the force which the device 29 must develop to hold or move the plate valve member in or to the closed position.

It will be noted that the length of the drilling 23 and therefore the volume of fuel contained in it is small. The volume of fuel contained in the drilling should therefore have little effect upon the performance of the nozzle and high pressure pump.

In order to cool the solenoid of the device 29, a restricted flow of fuel is allowed by way of a restrictor 32, from the annular chamber with which the passages 20 communicate. The fuel flows into the housing of the device and is then allowed to flow through a passage 33 communicating with the passage 25, the passage 33 also completing the connection of the passage 31 when the plate valve member 27 is in contact with its seating. The provision of the restrictor 32 also allows air in the various passages and spaces within the nozzle and in the low pressure fuel circuit and pumping chamber to escape to drain.

I claim: CLAIMS

1. A fuel injection nozzle for supplying fuel to an internal combustion engine comprising a valve member movable by fuel under pressure away from a seating to allow fuel flow through an outlet, resilient means biasing the valve member into contact with the seating and a spill valve including a spill valve member operable to allow spillage of fuel from an inlet of the nozzle, a spill valve seating, the spill valve member being biased into contact with the spill valve seating by said resilient means to prevent flow of fuel from the nozzle inlet to a drain, the spill valve member including a piston portion slidable in a cylinder and electromagnetic valve means for admitting fuel under pressure from the nozzle inlet into said cylinder to cause movement of the spill valve member to the open position.

2. A nozzle according to claim 1 in which said spill valve member includes a head which is connected to the piston portion by a reduced portion, said reduced portion forming with the cylinder an annular chamber which is connected by a drilling with the nozzle inlet.

3. A nozzle according to claim 2 including a nozzle body in which is located the valve member, a spill valve housing in which is formed the cylinder, a tubular member located between the nozzle body and the spill valve housing and in which is located the resilient means said tubular member defining a drain passage through which the spilled fuel can escape from the chamber defined by the tubular housing when the spill valve member is moved to the open position, and means acting to secure said housing, the body and the tubular member in assembled relationship.

4. A nozzle according to claim 3 in which said means comprises a cap nut which is in screw thread engagement with an injector body, said injector body mounting said electromagnetic valve means and also mounting a pump barrel in which is mounted a reciprocable pumping plunger.

* * * * *